United States Patent [19]

Bals

[11] 4,225,084

[45] Sep. 30, 1980

[54] ROTARY ATOMIZER WITH ASYMMETRICAL TEETH

[75] Inventor: Edward J. Bals, Bromyard, England

[73] Assignee: Pennbrook Corporation, Far Hills, N.J.

[21] Appl. No.: 942,158

[22] Filed: Sep. 14, 1978

[30] Foreign Application Priority Data

Sep. 14, 1977 [GB] United Kingdom ..... 38250/77

[51] Int. Cl.[2] ..... B05B 3/02

[52] U.S. Cl. ..... 239/223; 239/500

[58] Field of Search ..... 239/500, 501, 222.11, 239/222.13, 222.15, 222.17, 222.19, 222.21, 102, 223, 224, 382, 483, 523

[56] References Cited

U.S. PATENT DOCUMENTS

| | | | |
|---|---|---|---|
| 2,220,275 | 11/1940 | Preston | 239/223 |
| 2,369,216 | 2/1925 | Crisp | 239/223 |

*Primary Examiner*—James B. Marbert

*Attorney, Agent, or Firm*—Schuyler, Birch, McKie & Beckett

[57] ABSTRACT

A rotary atomizer suitable for spraying crops with liquid in the shape of a hollow truncated cone having a toothed periphery and internal radial grooves has asymmetric teeth, one side of each tooth being radial and the other side of each tooth being disposed at an angle, preferably 30°-60° to the radius. The grooves lead to the gaps between teeth and may be similarly assymmetrical.

The atomizer is unidirectional being rotated so that the radial teeth edges are the leading edges. It may be used singly, or as a stack of cones.

9 Claims, 5 Drawing Figures

Figure 2:
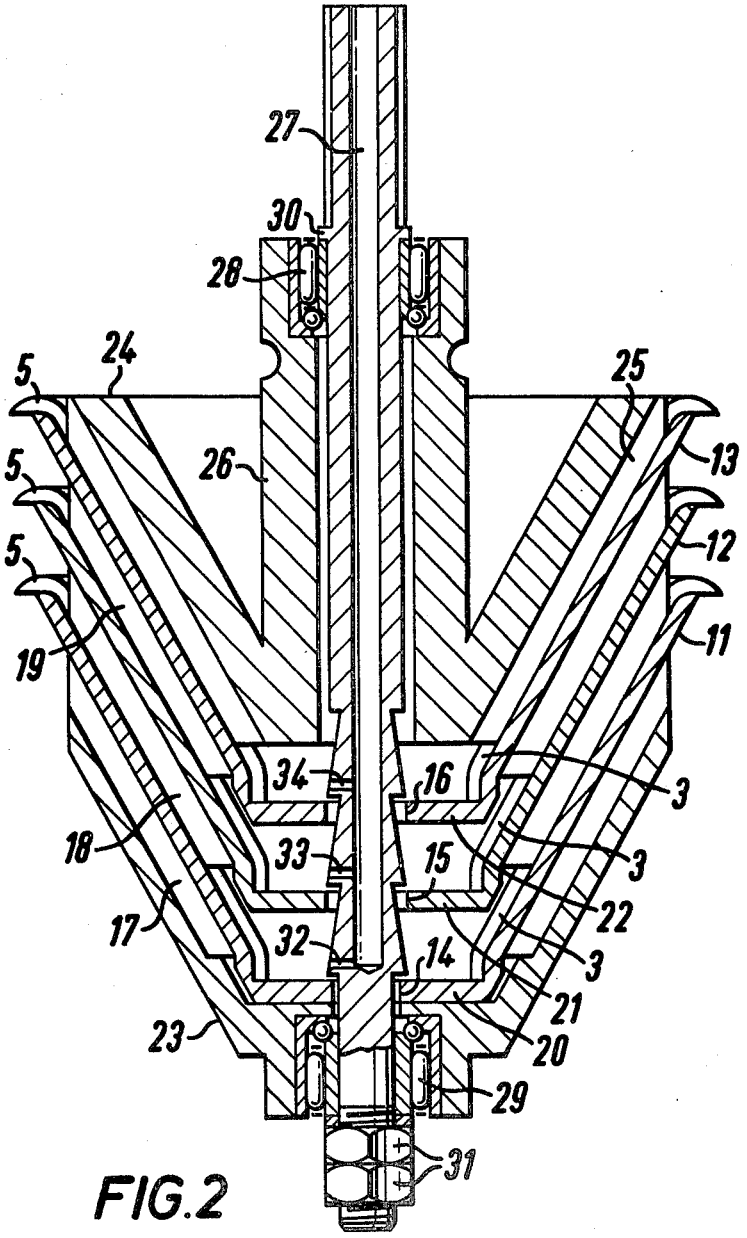

FIG.1(B)
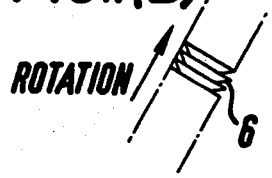
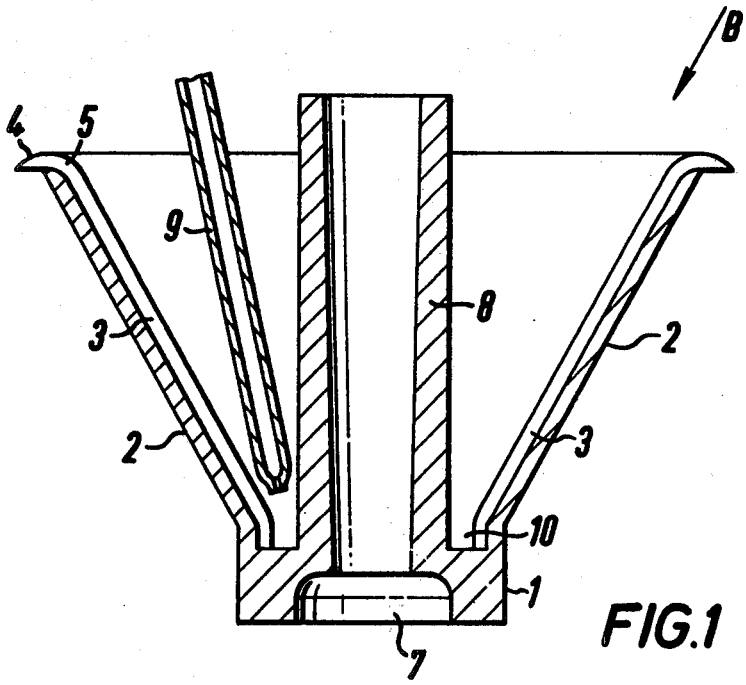
FIG.1

ROTARY ATOMIZER WITH ASYMMETRICAL TEETH

This invention relates to rotary atomisers, and has particular, though not exclusive, application to crop-spraying equipment.

Liquid sprays are applied to crops and agricultural land for a variety of reasons but a principal use is for the application of pesticides, which may be herbicides, insecticides or fungicides. For efficient use of these relatively costly materials it is important that the droplets in the spray are of a size suitable for the application (usually between 20–500 microns diameter). Ideally the droplets should be of a completely uniform size, and the nearer this ideal can be approached the better.

Conventional pressure atomisers are not capable of giving uniform size droplets, so rotary atomisers are preferred, e.g., discs or hollow cones. Liquid is fed to the center of the atomiser and rotation results in migration of the liquid to the periphery and discharge as a spray of droplets. The atomiser may have a serrated perimeter so that the liquid is discharged at a series of points of small dimensions, and it may have radial grooves to feed the liquid to these points. Such a design is based on the observation that the best results in terms of droplet size and uniformity of size, are obtained if the liquid issues as discrete filaments which are broken up into droplets after leaving the atomiser.

However, there are practical difficulties in ensuring that the streams of liquid remain separate both on the atomiser and after discharge, particularly with larger size atomisers and relatively high liquid feed rates.

According to the present invention a rotary atomiser comprising a hollow truncated cone having a toothed periphery and radial grooves on the inner side of the cone leading to the periphery is characterized in that one side of each tooth is radial and the other side is at an angle to the radius.

Preferably the teeth are in the form of a turned-over lip which is at right angles to the axis of the cone. Where the inside of the cone turns over to form the toothed lip, the angle is also preferably rounded to form a smooth curve from the inside of the cone to the tip of each tooth.

Unlike earlier grooved atomisers with symmetrical teeth, the atomiser of the present invention is unidirectional and is rotated so that the radial edge of each tooth is the leading edge. Each groove leads to the angle between adjacent teeth, and by rotating the disc in the direction indicated each stream of liquid is encouraged to transfer from the grooves to the radial side of the adjacent tooth rather than the angled side of the next tooth. When the teeth are in the form of a turned-over lip, the rounded contour between the inside of the cone and the teeth is also important in ensuring a smooth and even transfer of liquid from the grooves to the tips of the teeth.

The grooves may be asymmetric with one side at 90° and the other at an angle of 30°–60°, preferably 45°. As previously indicated the grooves lead to the angles between the teeth, so if these angles are continued onto the teeth, the teeth will be asymmetric also with one radial edge and one edge theoretically at 45° to the radius. In practice, the preferred technique of manufacture by injection moulding will tend to give a convex curved edge on the nonradial side of each tooth. The nonradial edge may thus be straight or curved and the angle, or average angle with a curved surface, is not critical but may conveniently be from 30° to 60° and preferably 45°.

The number of teeth can vary depending on the size of the atomiser and is preferably as high as possible consistent with manufacturing limitations, e.g., from 50 to 500. The angle of the cone may also vary but may conveniently be from 45° to 75°, and preferably about 60° to the axis of the cone. The angle of the cone, for a given rotational speed, regulates the centrifugal force which feeds the liquid along the grooves, and the preferred relatively large angles give a slow even feed to the teeth, the grooves acting in effect as a reservoir for the liquid along with the center part of the cone.

The cones may be manufactured by injection moulding from a suitable plastic, e.g., polypropylene or acetal.

An atomiser of the present invention may be used singly, in which case the cone may have a central, hollow, axial shaft within it. Bearings at either end of the shaft support and hold the cone. The cone may be driven in any suitable manner, e.g., by a belt or gearing on the shaft or directly by an electric motor. Liquid may be fed to the inside of the cone from a stationary pipe projecting into the inside of the cone. For simple spraying equipment this pipe may be gravity fed from a suitable container; alternatively liquid may be pumped continuously or intermittently to the inside of the cone.

If the cone is driven by an electric motor, a two- or multi-speed motor may be used, thereby increasing the versatility of the atomiser.

Another method of driving may be a turbine using the spraying liquid as the motive force. A turbine driven rotary atomiser is also described in my co-pending U.S. patent application Ser. No. 942,157. In this design the atomiser may have a central axial shaft extending from the base of the cone through the interior of the cone and a liquid jet driven turbine (e.g., a Pelton wheel) on the axial shaft, with the turbine having an opening on the side nearest the cone so that liquid can flow from the turbine to the interior of the cone. A nonrotary guard may be used to direct the liquid from the turbine to the base of the cone and prevent it impinging directly onto the interior walls of the cone.

It has been found that an atomiser can be driven by a turbine using only the amount of liquid to be discharged from the cone, there being no recycle of liquid.

In another embodiment, a stack of two or more cones may be used, with each cone suitably spaced from the next to allow flow of liquid into the inside of the cone and along the radial grooves. A rotary atomiser formed from a stack of suitably spaced cones is also described in my co-pending U.S. patent application Ser. No. 942,159. A suitable way of spacing the cones is to have a small number of ribs on the outside of the cones. Each rib mates with a groove on the inside of the adjacent cone, and by making the depth of each rib greater than the depth of the groove the cones are held in a spaced apart position. The ribs may be, for example, twice the depth of the grooves and the number of ribs may be as low as 4, thereby minimising the number of grooves which are rendered inoperative for feeding liquid to the teeth. A practical upper limit for the number of ribs may be 20. The spacing of cones is necessary to prevent liquid becoming trapped between the cones under capillary forces.

In a stacked assembly the cones have no central hollow axial shaft but have central holes through their bases. The assembly can then be held by conical end members through thrust bearings at either end onto a central stationary spindle. The spindle passes through the assembly with a small clearance where it passes through individual cones.

The conical end members may be of the same general shape as the atomising cones with ribs and grooves as necessary to hold the assembly together but without lips and teeth.

The total number of cones will depend on the total liquid delivery rate required but may conveniently be from 2 to 10.

In a stacked assembly, the central spindle may be hollow and liquid may be fed through it. One or more holes from the interior to the exterior of the spindle slightly above the point where the spindle passes through each cone then allows the liquid to pass from the center of the spindle to the inside of each cone. The spindle may be notched where it passes through the cones to minimize passage of liquid from one cone to another through the clearance gaps.

As previously indicated, the essence of the atomisers of the present invention is the design of the teeth and the grooves, which in co-operation ensure that the liquid is fed as separate streams alongside the inside of the cone and onto the tip of each tooth. Once this is achieved, then control of the size of the droplets can be regulated by regulating the rate of feed of liquid to the atomiser. For a given rotational speed, higher feed rates give larger streams and filaments and hence larger droplets, and it has been found that droplet size can be controlled by feed rate to give reasonably uniform size droplets of any size within the range 30 to 300 microns. For a given feed rate, decreasing the rotational speed also increases the droplet size.

There are thus various parameters which can be used to control droplet size, and this gives considerable flexibility in designing spraying equipment particularly as regards the size of the sprayer and its rate of delivery. It is a particular feature of the atomisers of the present invention that they can be used for larger sprayers, e.g., tractor or aircraft mounted sprayers as well as the smaller hand-held sprayers. By way of illustration only, atomisers may have maximum diameters of from 5 to 12 cm., rotational speeds of from 1,000 to 20,000 rpm and liquid feed rates of from 15 to 300 ml/minute (per disc).

Figure 3:
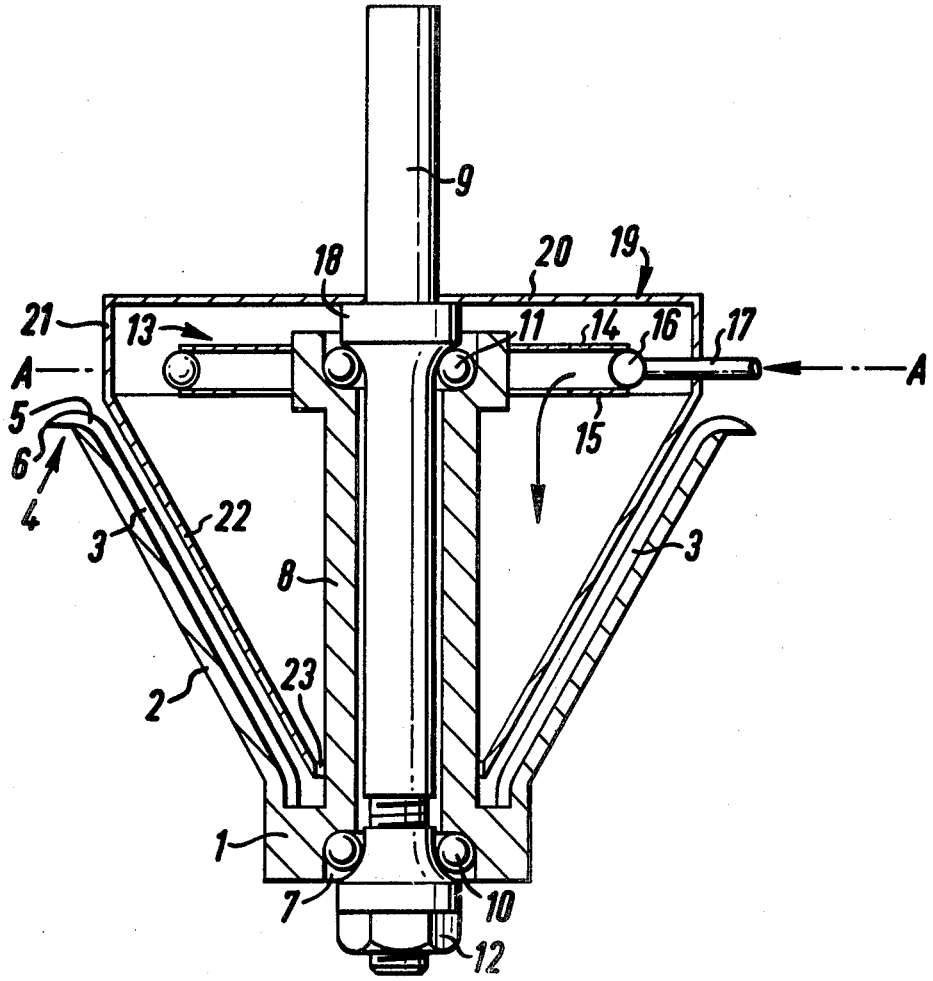
Figure 4:
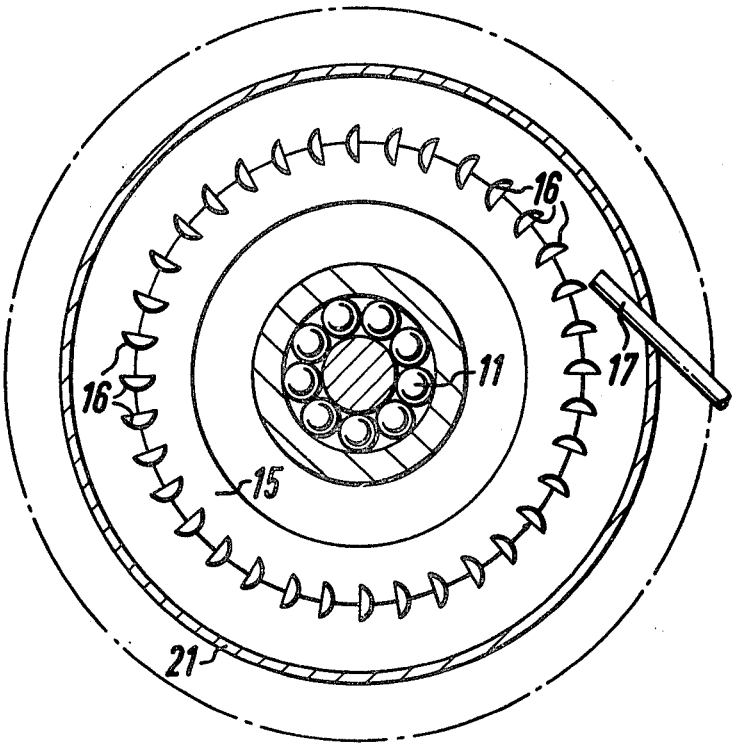

The invention is illustrated with reference to the accompanying drawings in which FIG. 1 is a section through a single atomiser, FIG. 2 is a section through a stack of atomisers, FIG. 3 is a section through a turbine driven rotary atomiser, and FIG. 4 is a section along the line A—A of FIG. 3.

In FIG. 1 a hollow truncated cone has a flat base 1, and a skirt 2 inclined at an angle of 60° to the axis of the cone. On the inside of the skirt are radial grooves 3, there being 180 in all. The top of the skirt is turned over to form a lip 4 at right angles to the central axis of the cone and the inner surface of the cone has a smooth rounded contour 5 where the angle changes. The lip is formed of 180 teeth 6, the shape of which is shown by the detail (FIG. 1(B)) which is a view from direction B in FIG. 1. It will be seen that each tooth 6 has one edge which is radial with respect to the central axis of the cone and one edge which is curved and at an angle to the radius. Each groove 3 is asymmetric, one side being at 90° and the other at 45°, and the top of each groove 3 is of the same width and contour as the gap between the teeth to give a smooth feed-way for liquid from each groove to each tooth.

The flat base 1 has a hollow portion 7, and a hollow central shaft 8 extends upwardly from the base. A bearing (not shown) may be seated in the hollow portion 7, and there may be another bearing (not shown) at the top of shaft 8. The cone is rotatable about the bearings, the drive being either from a belt (not shown) around the shaft 8 or directly from a motor (not shown). The direction of rotation is counterclockwise as shown by the arrow of FIG. 1(B) so that the radial edge of each tooth is the leading edge.

A stationary pipe 9 is positioned within the cone, this pipe being connected to a reservoir for liquid (not shown). In operation liquid flows by gravity from the reservoir through pipe 9 to form a pool of liquid in the annulus 10 at the base of the cone.

As the cone is rotated, separate discrete streams of liquid are drawn along each groove. When the liquid reaches the lip, the rotation of the cone causes each stream to cling to the leading radial edge of each corresponding tooth and not to partition itself between adjacent teeth.

Even if the air flow over the teeth caused by the rotation interferes with the flow along the radial edge to such an extent that some liquid is carried across a tooth to its other nonradial edge, surface tension and centrifugal force will still encourage this liquid to travel along the nonradial edge to the tip of the tooth rather than transferring to the adjacent tooth. Consequently each stream is discharged from the tip of each tooth as separate, discrete, filaments of uniform diameter. As the filaments are thrown off from the teeth into the surrounding air they break up into uniform, small size droplets.

FIG. 2 shows a stack of atomisers illustrating a preferred way of assembling the atomisers of the present invention.

In FIG. 2, three cones, 11, 12, 13 are generally similar to the cone of FIG. 1, except that they have central holes 14, 15, 16 and no central axial shaft. They have grooves 3 and toothed lips 5 as for FIG. 1, but they also have, on their under surfaces, ribs 17, 18, 19. Each cone has six ribs which are twice the depth of grooves 3 but of the same contour. The six ribs seating in six corresponding grooves therefore keep the cones in a fixed, spaced apart position. Each rib terminates at a point above the flat bases 20, 21, 22 of the cones.

The stack of cones is held together by end members 23, 24 of the same conical shape as the cones. Bottom end member 23 has six grooves to mate with ribs 17 of the bottom cone 11 but has no other grooves and no lip. Top end member has six ribs 25 to mate with six of the grooves 3 of top cones 13 but has no grooves or lip. It also has a hollow central shaft 26. A hollow central spindle 27 runs through the assembly, and there are combined needle and thrust bearings 28, 29 at either end of the spindle fitting into hollow portions of the end members 23, 24. The top end of the spindle has a shoulder 30 and the bottom end is screw threaded to receive nuts 31 so that the whole assembly is firmly held together. Needle and thrust bearings are preferred for long stacks but, for shorter stacks, simpler self-aligning cup and cone bearings may be adequate.

Spindle 27 is hollow for most of its length, and it has holes 32, 33, 34 from the interior to the exterior just above where the spindle passes through bases 20, 21, 22 of the cones. There are clearances between the spindle and the bases and, in this area of the assembly, the spindle has a serrated contour so that, just above each base the spindle has a diameter only slightly less than the diameter of the central holes 14, 15, 16 of the bases.

The assembly of FIG. 2 is operated similarly to FIG. 1. Thus the cones 11, 12, 13 and end members 23, 24 are rotated about the stationary central spindle 27 with the same direction of rotation as FIG. 1 so that the radial edge of each tooth is the leading edge. Liquid is fed under gravity or, preferably, under pressure to the hollow interior of the spindle 27 and passes through holes 32, 33, 34 to the inside of each cone. The serrated contour of the spindle where it passes through the cones helps to minimize any tendency for the liquid to fall under gravity from one cone to the next and hence overload the bottom cone. The travel of liquid along the grooves to the tips of the teeth then follows the same pattern as FIG. 1.

In FIG. 3, a turbine driven rotary atomiser has a hollow truncated cone with a flat base 1 and a skirt 2 inclined at an angle of 60° to the axis of the cone. On the inside of the skirt are radial grooves 3, there being 180 in all. The top of the skirt is turned over to form a lip 4 at right angles to the central axis of the cone and the inner surface of the cone has a smooth rounded contour 5 where the angle changes. The lip is serrated to give 180 teeth 6 having an asymmetric shape. One side of each tooth is radial to the central axis of the cone and the other is at an angle to the radius. The top of each groove 3 is of the same width and contour as the gap between the teeth to give a smooth feed-way for liquid along each groove to each tooth.

The flat base 1 has a hollow portion 7, and a hollow central shaft 8 extends upwardly from the base. A spindle 9 extends through the central shaft 8 and the base 1 of the cone, and there are cup and cone bearings 10, 11 within the hollow portion 7 of the base and the top of central shaft 8. Nut 12 at the bottom of the spindle 9 holds the cone and shaft on the spindle.

At the top of the shaft 8 is a Pelton wheel 13 formed of a circular top plate 14, an annular bottom plate 15 and vanes 16. A liquid feed pipe 17 is positioned close to the wheel and is tangential to it.

A shoulder 18 on spindle 9 supports a guard 19 having a flat top 20, a cylindrical portion 21 through which feed pipe 17 passes and a conical portion 22 at the same 60° angle as the skirt 2. There is an annular gap 23 between the foot of portion 22 of the guard and central shaft 8.

In operation liquid is directed through pipe 17 onto vanes 16 of the Pelton wheel 13 causing the wheel and cone to rotate on bearings 10, 11 around the stationary spindle 9. Liquid from the turbine drops under gravity from the inside of the wheel 13 through the center of the annular bottom plate 15 (as shown by the arrow) and onto the conical portion 22 of the stationary guard 19. The liquid then flows through gap 23 to the base 1 of the cone. Centrifugal force draws the liquid along grooves 3 as separate discrete streams of liquid to the lip 5 and teeth 6. The direction of rotation of the cone is such that the radial edge of each tooth 6 is the leading edge, and this encourages the liquid streams from grooves 3 to pass smoothly and evenly to each tip. The streams are discharged from each tooth as separate discrete filaments of uniform diameter, which break up, in the surrounding air into uniform, small size droplets.

I claim:

1. A rotary atomiser comprising:

a hollow cone having a base at its narrow end and a peripheral edge at its wide end, and adapted to be rotated about its central axis;

a plurality of teeth on the peripheral edge of said cone; and a plurality of radial grooves on the inner surface of said cone for directing streams of liquid to be atomised outwardly to said teeth where they are broken up into droplets of substantially uniform size;

each of said teeth comprising a radially disposed face and a nonradial face disposed at an angle to said radial face.

2. A rotary atomiser as claimed in claim 1, characterized in that the teeth are in the form of a turned-over lip at right angles to the axis of the cone.

3. A rotary atomiser as claimed in claim 1 characterized in that each of said grooves leads to the angle between two adjacent teeth.

4. A rotary atomiser as claimed in claim 1 characterized in that the angle, or average angle, of the non-radial face each tooth is inclined from 30° to 60° with respect to the radial face of the same tooth.

5. A rotary atomizer as claimed in claim 1 characterized in that the angle of the cone is from 45° to 75° to the axis of the cone.

6. A rotary atomiser as claimed in claim 1 characterized in that it consists of a stack of two or more cones suitably spaced from each other to allow flow of liquid into the inside of each cone and along the radial grooves.

7. A rotary atomiser as claimed in claim 6 characterized in that each cone has a small number of ribs on the outside mating with grooves on the inside of the adjacent cone to space the cones apart, and the cones are held by conical end members through thrust bearings at either end onto a central stationary spindle.

8. A rotary atomiser as claimed in claim 7 characterized in that the central stationary spindle is hollow and is provided with one or more holes from the interior to the exterior of the spindle, to allow liquid to be fed through the spindle to the inside of each cone.

9. A rotary atomiser as claimed in claim 1 characterized in that the cone has a central axial shaft extending from the base of the cone through the interior of the cone, and a liquid jet driven turbine on the axial shaft, the turbine having an opening on the side nearest the cone so that liquid can flow from the turbine into the interior of the cone.

* * * * *